US005926076A

United States Patent [19]

Johnson et al.

[11] Patent Number: 5,926,076

[45] Date of Patent: Jul. 20, 1999

[54] ADJUSTABLE BROADBAND DIRECTIONAL COUPLER

[75] Inventors: Joseph M. Johnson, Brewster; Glenn C. Werlau, Patterson, both of N.Y.

[73] Assignee: Werlatone, Inc., Brewster, N.Y.

[21] Appl. No.: 08/908,541

[22] Filed: Aug. 7, 1997

[51] Int. Cl.[6] ..... H01P 5/18

[52] U.S. Cl. ..... 333/109; 333/15

[58] Field of Search ..... 333/109, 111, 333/115

[56] References Cited

U.S. PATENT DOCUMENTS

| | | | |
|---|---|---|---|
| 2,936,417 | 5/1960 | Hedberg | 333/115 X |
| 3,166,723 | 1/1965 | Block et al. | 333/111 |
| 3,550,042 | 12/1970 | Werlau . | |
| 3,701,057 | 10/1972 | Hoer . | |
| 3,934,213 | 1/1976 | Stuckert . | |
| 4,121,180 | 10/1978 | Greenway . | |
| 4,578,702 | 3/1986 | Campbell, III . | |
| 5,304,961 | 4/1994 | Dydyk . | |
| 5,363,071 | 11/1994 | Schwent et al. | 333/111 |
| 5,461,349 | 10/1995 | Simons . | |

*Primary Examiner*—Paul Gensler
*Attorney, Agent, or Firm*—St. Onge Steward Johnston & Reens LLC

[57] ABSTRACT

An adjustable directional coupler including a housing, a first connector and a second connector secured to the housing, and a main transmission line extending through the housing and between the first and the second connectors. The main transmission line has a center conductor coaxially surrounded by an insulator. A circuit board is secured within the housing, with a first edge of the circuit board being generally parallel to the main transmission line and the circuit board being transversely adjustable with respect to the main transmission line. At least one auxiliary line is mounted on the circuit board and includes a pick-up link extending from a network juncture. The pick-up link is adjacent to and parallel with the first edge of the circuit board. A third connector is also secured to the housing. Preferably, the coupler further comprises a heat conductor mounted on the circuit board, in contact with the housing, and the auxiliary line includes a termination resistor connected to the pick-up link and mounted on the heat conductor.

15 Claims, 4 Drawing Sheets

ADJUSTABLE BROADBAND DIRECTIONAL COUPLER

FIELD OF THE INVENTION

The present invention relates to a directional coupler and, more particularly, to an adjustable broadband directional coupler that provides constant directivity and allows an exact setting of coupling to be easily made.

BACKGROUND OF THE INVENTION

A directional coupler is a measurement tool that samples a small portion of radio frequency and microwave energy traveling through a coaxial cable. The coupler can be thought of as two separate parts: 1) a circuit to sample the voltage in the coaxial cable, and 2) a current probe to sample the current in the coaxial cable. These samples provide two voltages, which add for current in one direction and subtract for current in the opposite direction, thereby giving the coupler its directivity properties.

There are three basic types of directional couplers: a 3-port uni-directional coupler, a 4-port bi-directional coupler, and a 4-port dual directional coupler. The uni-directional coupler consists of a transmission line and an auxiliary line, which is internally terminated at one end, with the other end acting as the coupling output. It is necessary to reverse the coupler physically for both forward and reverse power measurements. The bi-directional coupler is similar to the uni-directional coupler with the exception that both ends of the auxiliary line act as coupled outputs. This type of coupler can be used for simultaneously monitoring both forward and reflected power, but the directivity, which is the ratio in decibels of the power coupled out in the preferred direction to the power coupled out in the opposite direction, is dependent on the loads on the coupled outputs. The dual directional coupler employs two uni-directional couplers internally connected in tandem, to provide coupled outputs for both forward and reflected power. Unlike the bi-directional coupler, the directivity of the dual coupler is unaffected by the loads on the coupled outputs.

An example of an existing dual directional coupler is a coupler consisting of a transmission line extending between mainline input and output ports in the form of coaxial connectors. The transmission line has a center conductor surrounded by a dielectric layer, and the transmission line is enclosed in a solid housing, which serves the dual purposes of an outer conductor and an enclosure. The relative dimensions of the center conductor, dielectric and the housing are chosen to form a characteristic impedance, usually 50 ohms. The housing has two holes aligned with the center conductor, and two tubes each have open ends slidingly positioned within the holes. The opposite ends of the tubes extend out of the housing and terminate in coaxial connectors, which act as coupled outputs. A non-inductive termination resistor and pick-up link are placed across each of the tubes' open ends. The resistor is electrically connected to the tube, while a resistor lead on the opposite end of the resistor forms the pick-up link and bends up at a right angle into the tube and is connected to an amplitude equalizing circuit. The equalizing circuit comprises capacitance and a series resistance and is connected to the coupled output.

One tube of this directional coupler and its circuitry forms the forward auxiliary line, while the second tube and its circuitry forms the reverse auxiliary line. Coupling, which is the ratio in decibels of the forward power in the main transmission line to the power appearing at the coupled output, is adjusted by moving the tubes in and out of the housing to adjust the proximity of the pick-up links to the center conductor. Directivity is adjusted by rotating the tubes to properly align the pick-up links with the center conductor. These adjustments are somewhat interactive, requiring repeated fine tuning to achieve a desired result. In addition to the cumbersome adjustment procedure, this type of coupler suffers from at least four limiting factors: (1) the pick-up links are short, limiting the range of coupling factor, and suitability to frequencies below 100 MHz; (2) power handling must be sacrificed for tighter coupling; (3) the series resistive element in the coupled port dissipates power but is not heat sunk; and (4) the terminating resistor connected to the inside of the tube can not be effectively heat sunk.

A more recently developed dual directional coupler overcame many of the limiting factors of the above-described coupler. The coupler includes a larger housing containing a main transmission line, and one side of the housing is open to employ air as a dielectric and a circuit board is fixed within the housing. Pick-up links are placed parallel to the center conductor of the transmission line. The coupling factor is adjusted by changing the proximity of the links to the center conductor. Once adjusted, the pick-up links are actually permanently imbedded in the dielectric layer of the transmission line. Thereafter, each end of the links are bent at right angles, pass through the circuit board and are connected to amplitude equalizing circuits mounted partially on an opposite side of the circuit board and partially on the housing. The equalizing circuits are connected to coupled outputs.

This more recent coupler was an improvement over the prior dual directional coupler because: (1) the pick-up links are not limited in length, allowing tighter coupling, the only requirement being that the links be electrically short, or less than ¼ wavelength, for the frequencies involved. The coupler, therefore, is useful to frequencies as low as 1 MHz. In addition, with the transmission line and pick-up links contained within a larger housing, more room is available for the equalizing circuitry, allowing the use of more complicated networks without series resistance. The result is a coupler capable of wide-band operation over frequencies extending into the medium frequency and high frequency ranges; (2) power handling does not have to be sacrificed for tighter coupling, and the coupler is able to handle four times greater power for any given set of parameters than the above described coupler. For any given power requirement the coupling can be 6 dB tighter with this arrangement; and (3) any elements dissipating heat can be and are effectively heat sunk to the housing.

Adjusting the coupling factor, however, is difficult with this more recent coupler, requiring that the pick-up links actually be moved independently of the remainder of the auxiliary lines, permanently set or imbedded in the dielectric layer and then soldered to the remainder of the auxiliary lines. In addition, once the coupling factor is initially set, it very difficult to readjust the coupling since the original dielectric layer would have to be destroyed and replaced to move the imbedded pick-up links, which would than also have to be re-soldered to the remainders of the auxiliary lines. The link arrangement is also costly and time-consuming to manufacture, especially when the coupler is required to endure severe shock or vibration.

What is desired, therefore, is a dual directional coupler having forward and reverse coupled outputs that can be precisely, simultaneously, quickly and easily set to an exact coupling factor. Preferably, the coupler will be permanently aligned, have exceptional bandwidth and power handling ability and be capable of handling large amounts of average and peak power. The coupler should allow all power dissipating elements to be mounted to a common heat conductor so that all heat is transferred via conduction to coupler's housing. In addition, the housing of the coupler should be substantially shorter than the housings of existing quarter wavelength couplers, yet allow the use of complicated equalizing circuits and not limit the length of the pick-up links. The coupler should be rugged and able to withstand shock and vibration, be inexpensive to manufacture and its design should allow the coupler to exhibit lower tolerances, and consistent performance and quality from unit to unit.

SUMMARY OF THE INVENTION

Accordingly, it is an object of the present invention to provide a directional coupler having a pick-up link that can be precisely and easily set to an exact coupling factor.

It is another object of the present invention to provide a dual directional coupler having forward and reverse pick-up links that can be simultaneously set to an exact coupling factor.

It is yet another object of the present invention to provide a dual directional coupler having forward and reverse pick-up links that are permanently aligned.

A still further object of the present invention is to provide a directional coupler having pick-up links that are not limited in length.

It is a further object of the present invention to provide a directional coupler allowing all power dissipating elements to be connected to a common heat conductor so that all heat is transferred to the housing of the coupler.

An additional object of the present invention is to provide a directional coupler having a housing that is substantially shorter than the housings of existing quarter wavelength couplers, yet will not have a limited link length and will allow the use of complicated networks.

Another object of the present invention is to provide a directional coupler that is rugged and able to withstand shock and vibration.

It is yet another object of the present invention to provide a directional coupler that is inexpensive to manufacture.

A further object of the present invention is to provide a directional coupler that exhibits consistent performance and quality from unit to unit.

These and other objects of the invention are achieved by an adjustable directional coupler for use in high power operation over a wide bandwidth. The coupler includes a housing, a first connector and a second connector secured to the housing, and a main transmission line extending through the housing and between the first and the second connectors. The main transmission line has a center conductor coaxially surrounded by an insulator. The coupler also includes a circuit board secured within the housing, with a first edge of the circuit board being generally parallel to the main transmission line and the circuit board being transversely adjustable with respect to the main transmission line. At least one auxiliary line is mounted on the circuit board and includes a pick-up link extending from a network juncture. Because the auxiliary line is mounted on the adjustable circuit board, the auxiliary line is also adjustable with respect to the center conductor so that the coupling can be easily adjusted. The pick-up link is adjacent to, and parallel with the first edge of the circuit board, and therefore permanently aligned with the center conductor, so that the directivity of the coupler does not have to be adjusted. A third connector is also secured to the housing for the at least one auxiliary line.

According to one aspect of the present invention, the coupler further includes a heat conductor mounted on the circuit board and in contact with the housing. In this way, all heat dissipating elements of the coupler can be mounted on the heat conductor, so that heat can be transferred to the housing.

According to another aspect of the present invention, the auxiliary line further includes a termination resistor connected to the pick-up link and mounted on the heat conductor.

According to an additional aspect of the present invention, the at least one auxiliary line comprises a forward and a reverse auxiliary line, with the pick-up links of each auxiliary line extending to a termination resistor mounted on the heat conductor. The coupler, therefore, allows both auxiliary lines to be simultaneously moved with respect to the center conductor. The directional coupler further includes a fourth connector secured to the housing for the reverse auxiliary line.

According to a further aspect of the present invention, the forward and the reverse auxiliary lines each include an equalizing circuit connected between the network junctures and the third and the fourth connectors.

According to still another aspect of the present invention, the coupler further includes dissipating resistors mounted on the heat conductor and connected to the equalizing networks. Whereby, heat from the equalizing networks is preferably transferred to the housing.

Other objects, advantages and novel features of the invention will become apparent from the following detailed description of the invention when considered in conjunction with the accompanying drawings.

DETAILED DESCRIPTION OF THE INVENTION

Figure 6:
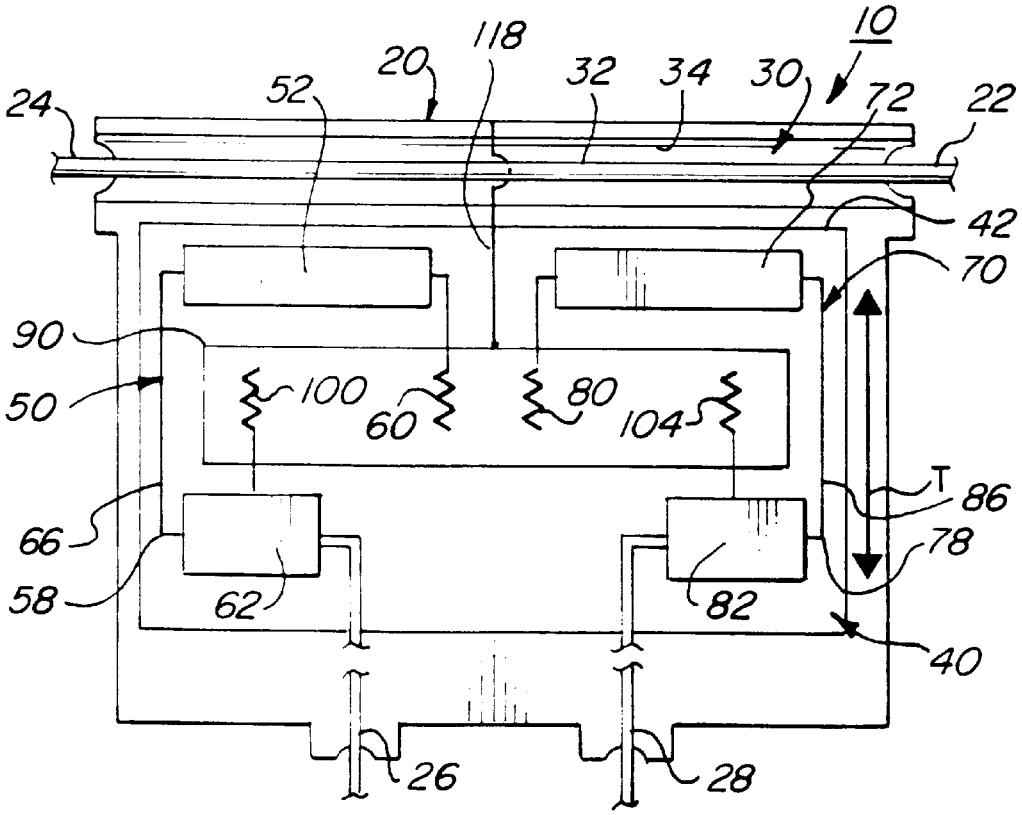
FIG. 6 is a schematic of the directional coupler of FIG. 1.

Referring first to the schematic of FIG. 6, the present invention generally provides a measurement tool in the form of an adjustable broadband directional coupler 10 for sampling microwave energy traveling through a coaxial cable (not shown). The directional coupler 10 includes a housing 20, a first connector 22 and a second connector 24 secured to the housing, and a main transmission line 30 extending through the housing and between the first and the second connectors. The main transmission line 30 has a center conductor 32 coaxially surrounded by a dielectric layer 34. The coupler 10 also includes a circuit board 40 positioned within the housing 20, with a first edge 42 of the circuit board being generally parallel to the main transmission line 30 and the circuit board being transversely adjustable with respect to the main transmission line, as illustrated by the line T. At least one auxiliary line 50 is mounted on the circuit board 40 and includes a pick-up link 52 extending from a network juncture 58. The pick-up link 52 is positioned adjacent to and parallel with the first edge 42 of the circuit board 40. The coupler 10 additionally includes a third connector 26 secured to the housing 20. The present invention, therefore, provides a directional coupler 10 having an auxiliary line 50 mounted on an adjustable circuit board 40 so that the pick-up link 52 is permanently aligned with the center conductor 32 and the coupling factor can be precisely and easily adjusted.

Preferably, the at least one auxiliary line comprises a forward auxiliary line 50, and the coupler 10 further includes a reverse auxiliary line 70 mounted on the circuit board 40. The reverse auxiliary line 70 also has a pick-up link 72 extending from a network juncture 78. The reverse pick-up link 72 is positioned adjacent to and parallel with the first edge 42 of the circuit board 40 and aligned end-to-end with the forward pick-up link 52. In addition, the reverse pick-up link 72 extends to a reverse termination resistor 80, while the forward pick-up link extends to a forward termination resistor 60.

The directional coupler 10 further includes a fourth connector 28 secured to the housing. A four port, dual directional coupler 10, therefore, is provided, with the coupling factor of both the forward and the reverse auxiliary lines 50,70 being simultaneously and easily adjustable. It should be noted, however, that the directional coupler 10 according to the present invention can alternatively be provided in the form of either a four port, bi-directional coupler or a three port, uni-directional coupler. As is known in the art, a uni-directional coupler generally has a single auxiliary line having a pick-up link extending between a link terminating resistor and an auxiliary output, while a bi-directional coupler has a single auxiliary line having a pick-up link extending between two auxiliary outputs. It should also be noted that it is contemplated that the reverse auxiliary line 70 could be mounted on a separate adjustable circuit board, whereby some of the novel features of the present invention could still be utilized to provide forward and reverse auxiliary lines that are easily adjustable. Preferably, however, both the forward and the reverse auxiliary lines 50,70 are mounted on one adjustable circuit board 40.

More preferably, the coupler 10 includes a heat conductor 90 mounted on the circuit board 40 and in contact with the housing 20, with each of the termination resistors 60,80 of the auxiliary lines 50,70 mounted on the heat conductor. In this way, power dissipated in the form of heat by the terminating resistors 60,80 can be transferred via conduction through the heat conductor 90 to the housing 20.

Even more preferably, the forward auxiliary line 50 further includes an equalizing circuit 62 connected between the forward network juncture 58 and the third connector 26, while the reverse auxiliary line 70 also includes an equalizing circuit 82 connected between the reverse network juncture 78 and the fourth connector 28. It is intended that the equalizing circuits 62,82 will actually be mounted on the circuit board 40 and connected to the third and the fourth connectors 26,28 via a flexible wire, whereby the equalizing circuits will also move with the circuit board.

Equalizing circuits, or amplitude equalizing circuits are known in the art and preferably have a loss and frequency characteristic opposite that of the pick-up link so that the resulting response at the coupled outputs is flat versus frequency. A full discussion of the operation of the coupler 10 with respect to the equalizing networks 62,82, however, is not included and equalizing circuits are not shown in FIGS. 1–5 discussed below since the theoretical operation is well known to those skilled in the art. Examples of equalizing networks can be found in any electronic designers' handbook. In general, however, equalizing circuits can include different combinations of components such as resistors, capacitors and/or transformers for example, and some of these components may dissipate power in the form of heat. Each of the auxiliary lines 50,70, therefore, further includes a dissipating resistor 100,104, respectively, mounted on the heat conductor 90 for connection to the equalizing circuits 62,82.

Advantageously, in the most preferred embodiment illustrated in FIGS. 1–5, the housing 20 of the directional coupler 10 is made of a conductive material, such as copper or aluminum for example, and includes a first housing section 110 and a second housing section 130. Each housing section 110,130 forms one half 112,132 of a cylindrical bore extending through the housing 20 and receiving the main transmission line 30, which is also cylindrical. The first housing section 110 includes a generally rectangular recess 114 extending transversely from the bore 112 and around a heat sink 118. The recess 114 and a top surface 120 of the heat sink 118 define screw holes 116,122 for securing the circuit board 40 and the heat conductor 90 within the recess, as discussed in more detail below. The second housing section 130 includes an access opening 134 above the recess 114 of the first housing section 110, and, as shown best in FIG. 2, the second housing section lies on top of the first housing section and the housing is secured together, with screws 136 for example. The housing 20 can also include a cover plate (not shown) for closing the access opening 134, which allows air to be used as a dielectric within the housing and around the circuit board 40.

The first and the second connectors 22,24 of the main transmission line 30 are coaxial connectors secured to the housing with screws, for example, and act, respectively, as a coaxial input and a coaxial output. The main transmission line 30 includes the center conductor 32, which is made of copper for example. The center conductor 32 extends between the first and the second coaxial connectors 22,24 and is coaxially surrounded by the dielectric layer 34. As is known in the art, a dielectric is a material that does not readily conduct electricity, i.e., an insulator. A good dielectric resists breakdown under high voltages, does not draw appreciable power from the circuit, and has reasonable physical stability. Preferably, the dielectric used is Teflon®. The dielectric layer 34 separates the center conductor 32 from the housing 20, which acts as an outer conductor. The dielectric layer 34 includes a groove 36 extending along its length, between the connectors 22,24 and parallel with the center conductor 32. The groove 36 does not expose the center conductor 32 but only extends part of the way through the dielectric layer 34 towards the center conductor.

The circuit board 40 is slidingly positioned within the recess 114, which is longer than the circuit board, and first edge 42 of the circuit board freely fits within the groove 36 of the dielectric layer 34. The circuit board 40 includes slotted mounting openings 44 which generally align with the screw holes 116 in the recess 114, and also includes an elongated aperture 46 which fits around the heat sink 118. The slotted mounting openings 44 and the elongated aperture 46 allow the position of the circuit board 40 with respect to a radial or transverse distance relative to the main transmission line to be adjusted so that the first edge 42 of the circuit board 40 can be moved into or out of the groove 36 of the dielectric layer 34 and, therefore, closer to or further from the center conductor 32. The top surface 120 of the heat sink 118 is level with a top surface 48 of the circuit board 40 when the circuit board is positioned within the recess 114.

Figure 1:
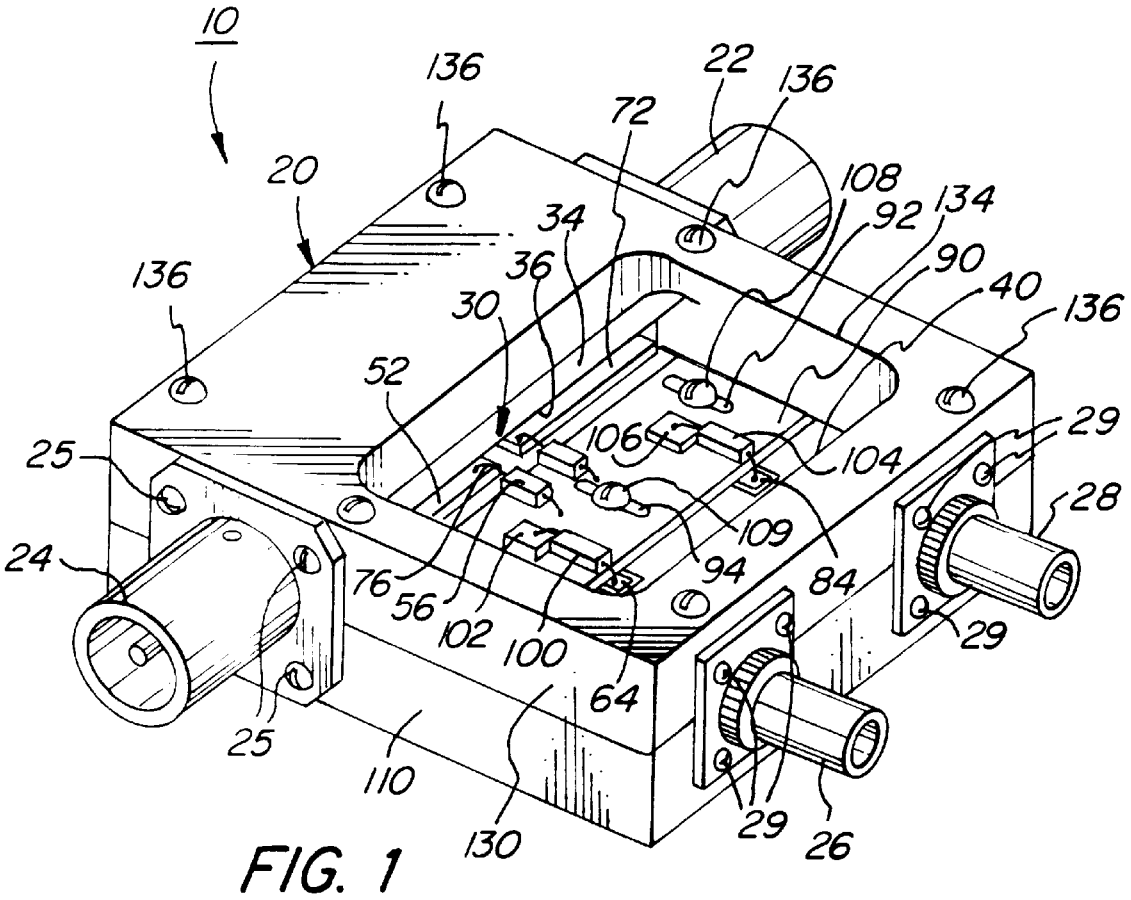
FIG. 1 is a top isometric view of an adjustable broadband directional coupler according to the present invention.
Figure 2:
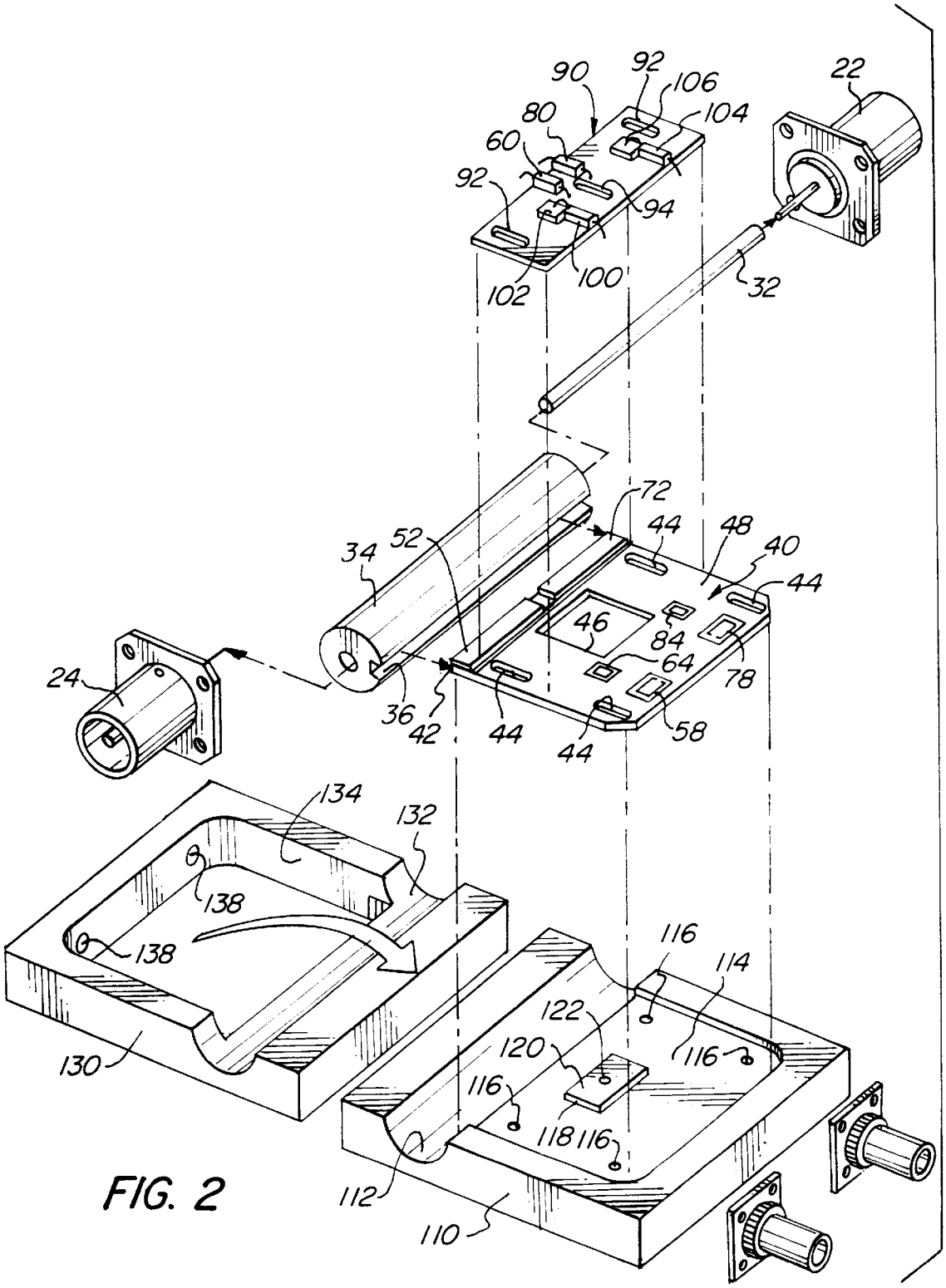
FIG. 2 is a top isometric, exploded view of the directional coupler of FIG. 1.
Figure 3:
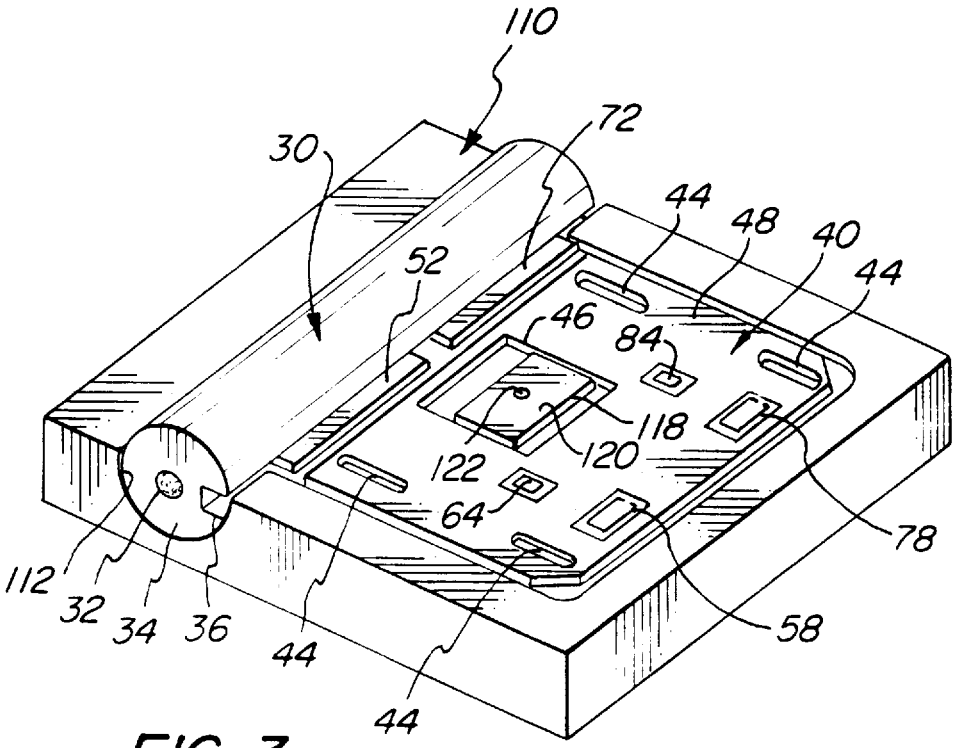
FIG. 3 is a top isometric view of the directional coupler of FIG. 1 shown without its heat conductor plate, adjustment screws, upper housing section or coaxial connectors.
Figure 4:
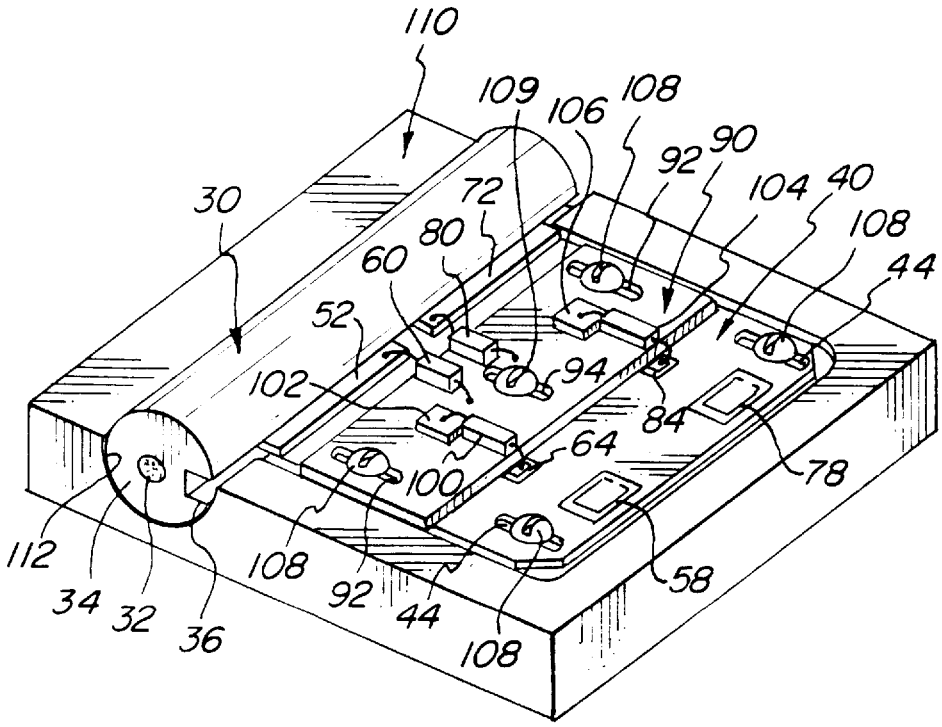
FIG. 4 is a top isometric view of the directional coupler of FIG. 1 shown without its upper housing section or coaxial connectors.
Figure 5:
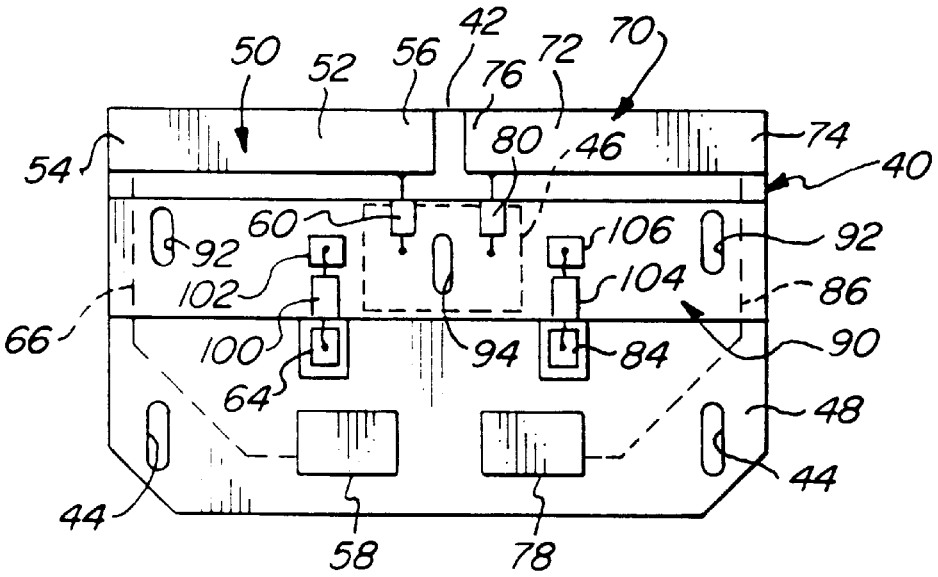
FIG. 5 is a top plan view of a circuit board of the directional coupler of FIG. 1.

The forward and the reverse auxiliary lines 50,70 are each mounted on the circuit board 40, as shown best in FIG. 5. The forward pick-up link 52, and the reverse pick-up link 72 are formed from a conductive material, such as copper or silver for example, printed on the top surface 48 of the circuit board 40. Each of the pick-up links 52,72 generally extends adjacent to and parallel with the first edge 42 and are therefore also parallel with, and accordingly, permanently aligned with the center conductor 32. With this configuration, only the coupling factor of the coupler 10, which is based upon the distance between the pick-up links 52,72 and the center conductor 32, and not the directivity of the coupler, which is based upon the alignment of the pick-up links with the center conductor, needs to be adjusted.

The exact coupling factor for any particular frequency range is determined by positioning the pick-up links 52,72 a correct distance from the center conductor 32. The tighter the coupling desired, the closer the pick-up links are coupled or positioned to the center conductor 32. The link length will also have an affect on the degree of coupling and, preferably, the pick-up links 52,72 each have a length substantially less than ¼ wavelength so that the coupling versus frequency characteristic tightens at 6 dB per octave with increasing frequency. Coupling is then set by positioning the circuit board 40 an exact distance from the center conductor 32 and fixing the circuit board in that position in the recess 114 of the lower housing section 110, as discussed in more detail below. Both the forward and the reverse auxiliary lines 50,70, therefore, are simultaneously and precisely set to obtain an exact coupling factor.

The forward pick-up link 52 extends between a coupled output end 54 and a termination end 56. The forward network juncture 58 is comprised of electrically conductive material printed on the top surface 48 of the circuit board 40, and is connected to the coupled output end 54 of the forward pick-up link 52 with a conductor 66 extending within the circuit board. The reverse pick-up link 72 extends between a coupled output end 74 and a termination end 76. The reverse network juncture 78 is also comprised of electrically conductive material printed on the top surface 48 of the circuit board 40, and is connected to the coupled output end 74 of the reverse pick-up link 72 with a conductor 86 extending within the circuit board. Two dissipating junctures 64,84 of electrically conductive material are also printed, spaced-apart, on the top surface 48 of the circuit board 40.

Although not shown in FIGS. 1–5, components of the equalizing circuits are connected to the network junctures 58,78, usually by soldering, to connect the equalizing circuits to the coupled output ends 54,74 of the pick-up links 52,72. The third and the fourth connectors 26,28 are coaxial connectors secured to the housing, with screws for example, and holes 138 in the second housing section 130 provide access for connecting the coaxial connectors to the equalizing circuits. Although not shown in FIGS. 1–5, the third coaxial connector 26 is connected to the forward equalizing network, preferably with a flexible wire that will allow the circuit board 40 to slide back and forth freely within the recess. The third coaxial connector 26 acts as the forward coupled coaxial output. The fourth coaxial connector 28 is connected to the reverse equalizing network, preferably with a flexible wire, and acts as the reverse coupled coaxial output. The forward and the reverse coupled coaxial outputs 26,28 are for connecting the directional coupler 10 to analyzing or monitoring equipment for monitoring or measuring the radio frequency and microwave energy traveling in one direction or the opposite direction through a coaxial cable intersected by the coupler and connected to the coaxial input 22 and the coaxial output 24 of the main transmission line 30, as is generally known in the art.

The heat conductor, which is preferably provided in the form of a flat, metal heat conductor plate 90, is secured to the top surface 48 of the circuit board 40 with soldering, for example. The heat conductor plate 90 is positioned above the elongated aperture 46 and is in contact with the top surface 120 of the heat sink 118. In effect, the heat conductor plate 90 moves with the circuit board 40 as the circuit board's position with respect to main transmission line 30 is adjusted. Yet the heat conductor plate 90 is always in contact with the heat sink 118 so that any heat imparted on the heat conductor plate can be transmitted, via conduction, to the housing 20 through the heat sink, to thereby provide efficient heat dissipation.

The heat conductor plate 90 includes a slotted mounting opening 94 that aligns with the elongated aperture 46 of the circuit board 40 and the screw hole 122 in the top surface 120 of the heat sink 118, and two slotted mounted openings 92 which align with two slotted mounting opening 44 of the circuit board 40. Fasteners 108, in the form of screws for example, extend through the slotted mounting openings 92,44 and into the screw holes 116 in the recess 114. Another fastener 109, in the form of a screw for example, extends through the slotted mounting opening 94 and the elongated aperture 46 into the screw hole 122 in the top 120 of the heat sink 118, for fixing the circuit board 40 in a selected position within the recess of the first housing section. It should be noted, however, that fasteners for securing the circuit board 40 in a preferred position are not limited to screws and slotted mounting openings.

The forward termination resistor 60 is connected to and extends at a right angle from the termination end 56 of the forward pick-up link 52. The reverse termination resistor 80 is connected to and extends at a right angle from the termination end 76 of the reverse pick-up link 72. Both the forward and the reverse termination resistors 60,80 are mounted on and connected to the heat conductor plate 90, whereby power, in the form of heat, dissipated by the resistors from the pick-up links 52,72 is transmitted through the heat conductor plate to the heat sink 118 of the housing 20. The termination resistors 60,80 can dissipate considerable power, depending on the coupling factor, bandwidth and power rating of the design.

The forward network resistor 100 is connected to the forward dissipating juncture 64 and mounted on the heat conductor plate 90 and connected to a first pad 102 of dielectric material secured to the plate. The reverse network resistor 104 is connected to the reverse dissipating juncture 84 and mounted on the heat conductor plate 90 and connected to a second pad 106 of dielectric material secured to the plate. Heat dissipated by the dissipating resistors 100, 104 from the equalizing networks is transmitted through the heat conductor plate 90 to the heat sink 118 of the housing 20. It should be noted however that the dissipating resistors 100,104 are only mounted on, and not connected to, the heat conductor plate 90, while the termination resistors 60,80 are both mounted to and connected to the plate.

In summary, the present invention provides an adjustable broadband dual directional coupler 10 having forward and reverse auxiliary lines 50,70 that can be precisely, simultaneously, quickly and easily set to an exact coupling factor. The coupler 10 is permanently aligned, has exceptional bandwidth and power handling ability (because the link lengths are not limited due to the design of the coupler) and is capable of handling large amounts of average and peak power. The coupler 10 also allows all power dissipating elements to be mounted to a common heat conductor 90 so that all heat is transferred via conduction to the coupler's housing 20. In addition, the housing 20 of the coupler 10 is substantially shorter than the housings of existing couplers, yet allows the use of complicated equalizing circuits and does not limit the length of the pick-up links 52,72. The circuit board construction makes the coupler 10 rugged and able to withstand shock and vibration, and makes the coupler inexpensive to manufacture. Furthermore, the design of the coupler 10 ensures consistent performance and quality from unit to unit, and lower tolerances. In fact, it has been found that while existing couplers usually have a tolerance of ±1.0 decibels, a coupler according to the present invention typically has a tolerance of ±0.1 decibels.

Although the invention has been described with reference to a particular arrangement of parts, features and the like, these are not intended to exhaust all possible arrangements or features, and indeed, many other modifications and variations will be ascertainable to those skilled in the art.

What is claimed is:

1. A directional coupler comprising:

a housing;

a first connector and a second connector secured to the housing;

a main transmission line extending through the housing and between the first and the second connectors, the main transmission line having a center conductor coaxially surrounded by an insulator;

a circuit board secured within the housing, with a first edge of the circuit board being generally parallel to the main transmission line and the circuit board being transversely adjustable with respect to the main transmission line;

at least one auxiliary line mounted on the circuit board and including a pick-up link extending from a network juncture, the pick-up link adjacent to and parallel with the first edge of the circuit board;

a third connector coupled to the network juncture and secured to the housing, the third connector providing a coupled coaxial output; and a heat conductor mounted on the circuit board and in contact with the housing to dissipate heat generated within the directional coupler to the housing.

2. A directional coupler according to claim 1 wherein the auxiliary line further includes a termination resistor connected to the pick-up link and mounted on the heat conductor.

3. A directional coupler according to claim 1 wherein:

the at least one auxiliary line comprises a forward and a reverse auxiliary line, with the pick-up links of each auxiliary line extending to a termination resistor mounted on the heat conductor;

the third connector provides a coupled coaxial output for the forward auxiliary line; and the directional coupler further includes a fourth connector secured to the housing, the fourth connector providing a coupled coaxial output for the reverse auxiliary line.

4. A directional coupler according to claim 1 further comprising a dissipating resistor mounted on the heat conductor.

5. A directional coupler according to claim 1 wherein the housing has a heat sink extending through an elongated aperture of the circuit board and contacting the heat conductor.

6. A directional coupler according to claim 1 wherein the auxiliary line further includes an amplitude equalizing circuit connected between the network juncture and the third connector.

7. A directional coupler according to claim 1 further comprising fasteners securing the circuit board once preferably positioned relative to the main transmission line.

8. A directional coupler comprising:

a housing;

a first connector and a second connector secured to the housing;

a main transmission line extending through the housing and between the first and the second connectors, the main transmission line having a center conductor coaxially surrounded by an insulator, the insulator having a groove extending parallel with the center conductor; and at least one auxiliary line adjustably positioned within the housing with respect to the main transmission line and including a pick-up link extending from a network juncture, the pick-up link extending parallel with the center conductor and being aligned with the groove, the auxiliary line including an amplitude equalizing circuit connected to the network juncture.

9. A directional coupler according to claim 8 further comprising a heat conductor attached to the auxiliary line and in contact with the housing.

10. A directional coupler according to claim 9 wherein the pick-up link of the auxiliary line extends to a termination resistor mounted on the heat conductor.

11. A directional coupler according to claim 9 wherein a dissipating resistor is mounted on the heat conductor.

12. A directional coupler according to claim 9 wherein the at least one auxiliary line comprises a forward auxiliary line and a reverse auxiliary line, with the pick-up link of each auxiliary line terminating in a termination resistor mounted on the heat conductor plate.

13. A directional coupler according to claim 8 further comprising at least one fastener securing the auxiliary line once preferably positioned relative to the main transmission line.

14. A directional coupler comprising:

a housing;

a main line input and a main line output secured to the housing;

a main transmission line extending through the housing and between the main line input and the main line output, the main transmission line having a center conductor coaxially surrounded by an insulator;

a heat conductor contacting the housing;

a forward auxiliary line including a pick-up link extending from an amplitude equalizing circuit to a termination resistor mounted on said heat conductor, the pick-up link generally parallel with the center conductor;

a reverse auxiliary line including a pick-up link extending from an amplitude equalizing circuit to a termination resistor mounted on said heat conductor, said pick-up link generally parallel with the center conductor;

a forward coupled output secured to the housing and connected to the equalizing circuit of the forward auxiliary line; and a reverse coupled output secured to the housing and connected to the equalizing circuit of the reverse auxiliary line.

15. A directional coupler according to claim 14 wherein each of the forward and the reverse auxiliary lines further includes a dissipating resistor connected to the equalizing circuit and mounted on the heat conductor.

* * * * *